US006121333A

United States Patent [19]

Clerici et al.

[11] Patent Number: 6,121,333

[45] Date of Patent: Sep. 19, 2000

[54] PROCESS FOR THE PREPARATION OF HYDROCARBONS FROM SYNTHESIS GAS

[75] Inventors: Gabriele Carlo Ettore Clerici, Milan; Vincenzo Piccolo, Paullo; Giuseppe Belmonte, San Giuliano Milanese, all of Italy; Paul Broutin, Chaponost; François Hugues, Charly, both of France

[73] Assignees: AGIP Petroli S.p.A., Rome, Italy; Institut Francais du Petrole, Rueil-Malmaison, France

[21] Appl. No.: 09/335,484

[22] Filed: Jun. 18, 1999

[30] Foreign Application Priority Data

Jun. 25, 1998 [IT] Italy ..... MI98A1451

[51] Int. Cl.[7] ..... C07C 27/00; C07C 5/00; C07C 1/00

[52] U.S. Cl. ..... 518/715; 518/700; 518/706; 585/265; 585/330

[58] Field of Search ..... 518/715, 706, 518/700; 585/265, 330

[56] References Cited

U.S. PATENT DOCUMENTS 4,097,364 6/1978 Egan .

4,684,756 8/1987 Derr et al. ..... 585/330

FOREIGN PATENT DOCUMENTS 0 147 873 7/1985 European Pat. Off. .
0583836 2/1994 European Pat. Off. .
0 609 079 A1 8/1994 European Pat. Off. .
0 756 895 A2 2/1997 European Pat. Off. .

*Primary Examiner*—Samuel Barts
*Assistant Examiner*—J. Parsa
*Attorney, Agent, or Firm*—Oblon, Spivak, McClelland, Maier & Neustadt, P.C.

[57] ABSTRACT

Process for the production of hydrocarbons from synthesis gas which comprises:

a) feeding to a reactor for Fischer-Tropsch reactions, containing a catalyst based on supported cobalt, a synthesis gas in molar ratios $H_2/CO$ ranging from 1 to 3;

b) discharging from the reactor a hydrocarbon liquid phase containing the catalyst, in suspension;

c) feeding the suspension to a hydrocracking reactor operating at a temperature ranging from 200 to 500° C.;

d) discharging a vapour phase from the head of the hydrocracking reactor and from the bottom a suspension containing heavier products which is recycled to the Fischer-Tropsch reactor;

e) cooling and condensing the vapour phase.

12 Claims, 2 Drawing Sheets

D1
R1
3
4
D2
R2
3'
4'
5
2
FT
6
9
HC
8
7
1
D3
R3
D4
R4
11
10

PROCESS FOR THE PREPARATION OF HYDROCARBONS FROM SYNTHESIS GAS

The present invention relates to a process for the production of hydrocarbons from synthesis gas.

More specifically, the present invention relates to a process for the production of hydrocarbons, liquid at room temperature and atmospheric pressure, from synthesis gas by means of the Fischer-Tropsch process.

The Fischer-Tropsch technology for preparing hydrocarbons from mixtures of gas based on hydrogen and carbon monoxide, conventionally known as synthesis gas, is known in scientific literature. A summary of the main works on the Fischer-Tropsch synthesis reaction is contained in the Bureau of Mines Bulletin, 544 (1955) entitled "Bibliography of the Fischer-Tropsch Synthesis and Related Processes" H. C. Anderson, J. L. Wiley and A. Newell.

In general the Fischer-Tropsch technology is based on the use of a reactor for chemical reactions which are carried out in triphasic systems where a gaseous phase bubbles into a suspension of a solid in a liquid. The gaseous phase consists of synthesis gas, with a molar ratio $H_2/CO$ varying from 1 to 3, the dispersing liquid phase represents the reaction product, i.e. linear hydrocarbons mainly with a high number of carbon atoms, and the solid phase is represented by the catalyst.

The reaction product which is discharged from the reactor consequently consists of a suspension which must be treated to separate the solid (catalyst) from the liquid phase. Whereas the catalyst is recycled to the synthesis reactor, the liquid is subjected to subsequent treatment, for example hydrocracking and/or hydroisomerization treatment, to obtain hydrocarbon fractions of industrial interest.

Published European patent application 609.079 describes a reactor for Fischer-Tropsch reactions consisting of a gas-bubbling column containing a suspension consisting of particles of catalyst suspended in the liquid hydrocarbon. The synthesis gas is fed to the base of the reactor whereas the synthesized hydrocarbon is recovered at the head.

To avoid entrainment of catalyst particles, the reactor is equipped with cylindrical filtration devices arranged inside the reactor in the upper part.

Published international patent application WO 97/31693 describes a method for separating a liquid from a suspension of solid particles which comprises, in a first phase, degassing the suspension and, in a second phase, filtrating the suspension through a tangential flow filter. In particular, the suspension comes from a Fischer-Tropsch reactor and consists of synthesized heavy hydrocarbons which entrain the catalyst particles.

Other examples of methods for separating the catalyst contained in the suspension leaving a Fischer-Tropsch reactor are described in published European patent application 592.176, in published international patent application WO 94/16807, in U.K. patent 2.281.224, in U.S. Pat. Nos. 4.605.678 and 5.324.335 and in German patent 3.245.318.

The filtered liquid hydrocarbon coming from the Fischer-Tropsch synthesis generally consists of mixtures of paraffins with a high molecular weight, for example mixtures comprising paraffins having up to, and over, 100 carbon atoms or having an average boiling point higher than 200° C. This is consequently a product which is of no particular practical industrial use but which must be subjected to further treatment, for example to hydrocracking and/or hydroisomerization treatment, to give it a composition which allows it to have a more practical use, for example as a component for fuels for road transport. Published European patent application 753.563 describes a process for the hydroisomerization of paraffinic waxes, in particular Fischer-Tropsch waxes by treatment with a catalyst based on a metal of groups IB, VIB and/or VIII, supported on silica-alumina, at temperatures ranging from 200 to 400° C.

The Applicants have now found a process for the production of liquid hydrocarbons which allows a combination of the Fischer-Tropsch process with a subsequent hydrocracking process of the hydrocarbon phase produced, at the same time enabling, as described above, the elimination of the separation step of the catalyst from the suspension produced. This operating step, as is demonstrated in the broad amount of patent literature on the subject, is a serious disadvantage for the Fischer-Tropsch process and is completely by-passed in the process of the present invention.

This result is possible as a catalyst has been found which has proved to be catalytically active both for the Fischer-Tropsch synthesis and for the subsequent hydrocracking reaction.

In addition, with the process of the present invention, a second significant result is obtained which relates to the regeneration of the catalyst. As the subsequent hydrocracking reaction is carried out in the presence of an excess of hydrogen, the oxides which are formed on the surface of the catalyst following secondary reactions connected with the Fischer-Tropsch reaction, are reduced to metal.

The present invention therefore relates to a process for the production of hydrocarbons from synthesis gas which comprises:

a) feeding continuously to the bottom of a reactor for Fischer- Tropsch reactions, con taining a catalyst based on supported cobalt, a synthesis gas essentially consisting of hydrogen and carbon monoxide, in molar ratios $H_2CO$ ranging from 1 to 3;

b) continuously discharging from the reactor the Fischer-Tropsch reaction product essentially consisting of a hydrocarbon liquid phase containing the catalyst in suspension;

c) feeding the Fischer-Tropsch reaction product, together with a hydrogen stream, to a hydrocracking reactor operating at a temperature ranging from 200 to 500° C.;

d) discharging a vapour phase essentially consisting of light hydrocarbons from the head of the hydrocracking reactor and from the bottom a suspension containing heavier products, which is recycled to the Fischer-Tropsch reactor;

e) cooling and condensing the vapour phase leaving the hydrocracking reactor.

According to the process of the present invention, the reactor for Fischer-Tropsch-type reactions is a bubble reactor consisting of a container, generally vertical, for example a column, inside of which chemical reactions are activated, which take place in triphasic systems where a gaseous phase bubbles into a suspension of a solid in a liquid. In the present case, the gaseous phase consists of synthesis gas, with a molar ratio $H_2/CO$ varying from 1 to 3, the dispersing liquid phase represents the reaction product, i.e. linear hydrocarbons mainly with a high number of carbon atoms, and the solid phase is represented by the catalyst.

The synthesis gas preferably comes from steam-reforming or from the partial oxidation of natural gas or other hydrocarbons, on the basis of the reactions described, for example, in U.S. Pat. No. 5.645.613. Alternatively, the synthesis gas can come from other production techniques such as, for example, from "auto-thermal reforming" or from the gassification of carbon with water vapour at a high temperature, as described in "Catalysis Science and Technology", Vol. 1, Springer-Verlag, New York, 1981.

Two phases are substantially produced from the Fischer-Tropsch reaction, a lighter one, in vapour phase, essentially consisting of light hydrocarbons, water vapour, inert products, etc., which is discharged at the head together with the non-reacted gas, the other heavier phase essentially consisting of paraffinic waxes, liquid at the reaction temperature, comprising mixtures of saturated, linear hydrocarbons with a high number of carbon atoms. These hydrocarbon mixtures generally have a boiling point which exceeds 150° C.

The Fischer-Tropsch reaction is carried out at temperatures ranging from 150 to 400° C., preferably from 200 to 300° C., maintaining a pressure inside the reactor of 0.5 to 20 MPa. More specific details on the Fischer-Tropsch reaction are available in "Catalysis Science and Technology" mentioned above.

Finally, the catalyst is present inside the reactor, suspended in the hydrocarbon liquid phase. The catalyst is based on cobalt, in metal form or in the form of oxide or (in)organic salt, dispersed on a solid carrier consisting of at least one oxide selected from one or more of the following elements: Si, Ti, Al, Zn, Mg. Preferred carriers are silica, alumina or titania.

In the catalyst, the cobalt is present in quantities ranging from 1 to 50% by weight, generally from 5 to 35%, with respect to the total weight.

The catalyst used in the process of the present invention can also contain additional elements. For example, it can comprise, with respect to the total, from 0.05 to 5% by weight, preferably from 0.1 to 3%, of ruthenium and from 0.05 to 5% by weight, preferably from 0.1 to 3% of at least a third element selected from those belonging to Group IIIB. Catalysts of this type are known in literature and described, together with their preparation, in published European patent application 756.895.

Further examples of catalysts are again based on cobalt but containing tantalum as promoter element in quantities of 0.05–5% by weight with respect to the total, preferably 0.1–3%. These catalysts are prepared by first depositing a cobalt salt on the inert carrier (silica or alumina), for example by means of the dry impregnation technique, followed by a calcination step and, optionally, a reduction and passivation step of the calcined product.

A derivative of tantalum (particularly tantalum alcoholates) is deposited on the catalytic precursor thus obtained, preferably with the wet impregnation technique followed by calcination and, optionally, reduction and passivation.

The catalyst, whatever its chemical composition may be, is used in the form of a finely subdivided powder with an average diameter of the granules ranging from 10 to 700 micrometers.

The liquid product of the Fischer-Tropsch reaction, which comprises both the heavier hydrocarbon phase and the catalyst, is continuously discharged from the synthesis reactor, brought to hydrocracking operating conditions with the conventional methods, and fed to the hydrocracking reactor, operating at temperatures ranging from 200 to 500° C., preferably between 300 and 450° C., and pressures ranging from 0.5 to 20 MPa. A stream of hydrogen is also fed, contemporaneously, to the hydrocracking reactor, of a type analogous to the Fischer-Tropsch reactor.

The Fischer-Tropsch reaction product is preferably fed to the head of the hydrocracking reactor whereas the hydrogen is fed, in excess, to the base forming a stream in countercurrent with the descending product.

A vapour phase essentially consisting of $C_{5-}$–$C_{25+}$ paraffins is discharged from the head of the reactor and is subsequently condensed. The end mixture thus obtained has a boiling point lower than that of the hydrocracking reactor.

The heavier product, still liquid at the operating temperature of the hydrocracking reaction, is collected on the bottom of the reactor and is continuously recycled to the Fischer-Tropsch synthesis. This continuous stream of suspension in a closed cycle, from one reactor to the other, also guarantees a second result which is the continuous regeneration of the catalyst which would otherwise be slowly deactivated by the secondary oxidative reactions arising in the Fischer-Tropsch reaction.

Figure 1:
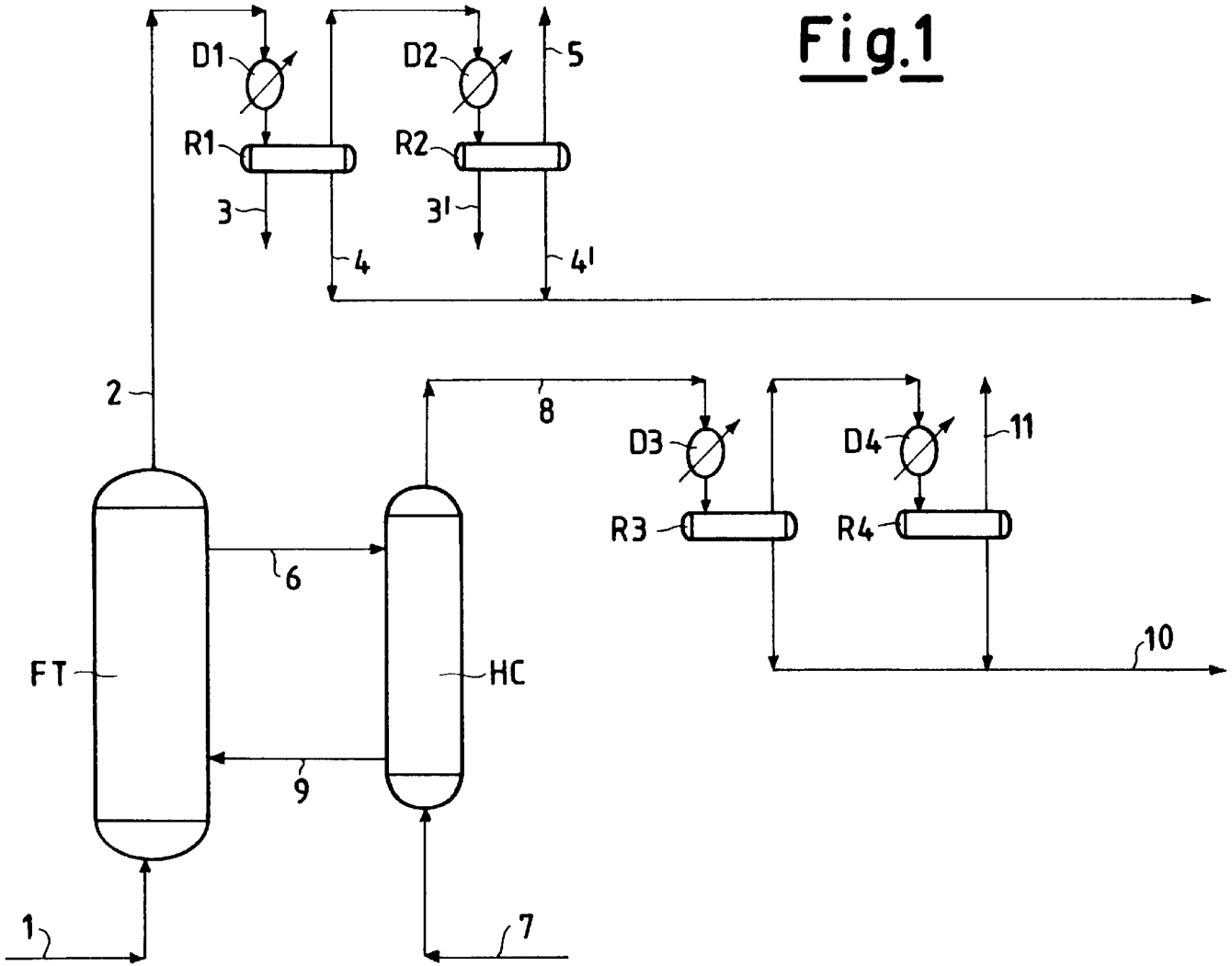
FIG. 1 is a schematic drawing of a Fischer-Tropsch reactor according to the present invention.

The process for the production of hydrocarbons from synthesis gas of the present invention can be better understood by referring to the process of FIG. 1 enclosed which represents an illustrative but non-limiting embodiment.

With reference to FIG. 1, the process scheme comprises: a Fischer-Tropsch reactor (FT), a hydrocracking reactor (HC), condensers (D1)–(D4) with the corresponding collecting containers of the condensate (R1)–(R4).

The functioning of the present process is evident from the enclosed scheme and previous description. The synthesis gas (1) is fed to the reactor (FT) in which there is the suspension consisting of liquid paraffinic waxes and the catalyst. Two streams are discharged from the head of the reactor (FT).

The first stream (2) is in vapour phase and essentially consists of non-reacted synthesis gases, reaction by-products (mainly water), inert products and "light" paraffins, for example $C_{13-}$. This stream is fed to the condensers (D1) and (D2), arranged in series, from which the reaction by-products (3) and (3') and condensable hydrocarbons (4) and (4') are recovered, whereas the remaining products, essentially synthesis gases, inert products and lighter hydrocarbons (mainly methane), are discharged in vapour phase by means of (5) and sent for further treatment.

The second stream (6), consisting of paraffinic waxes liquid under the operating conditions, and the catalyst, is fed to the head of the hydrocracking reactor (HC) to whose base hydrogen is fed by means of (7). The cracking product, together with the non-reacted hydrogen, is discharged by (8) whereas the heavy product, still liquid, together with the catalyst, is collected at the bottom of the reactor (HC) and is recycled to the base of the reactor (FT) by means of line (9).

The vapours (8) are condensed in the condensers (D3) and (D4), arranged in series, from which the hydrocarbon fraction (10) is recovered. The uncondensable products, mainly hydrogen and methane, are discharged by means of line (11) and sent for subsequent treatment.

A few illustrative but non-limiting examples are provided for a better understanding of the present invention.

EXAMPLE 1

An alumina carrier (100% gamma crystalline phase, surface area 175 $m^2/g$, specific pore volume 0.5 $m^3/g$, average pore radius 40 Å, particle size between 20 and 150 $\mu$m, specific weight 0.86 g/ml) is dry impregnated with a nitric solution of $Co(NO_3)_2 \cdot 6H_2O$ at pH=5 in such quantities as to obtain a percentage of Co equal to 14% by weight referring to the total. The impregnated alumina is dried at 120° C. for 16 hours and calcined at 400° C. in air for 4 hours.

A solution of $Ta(EtO)_5$ 0.01 M in ethanol is added to the product thus obtained, in such a volume as to obtain an end weight percentage of tantalum equal to 0.5% by weight.

The suspension is then left under stirring for two hours and is subsequently dried under vacuum at 50° C. A calcination phase is then carried out in air at 350° C. for 4 hours.

63 g of the catalyst thus prepared are charged into a mechanically stirred "slurry" reactor having a diameter of 120 mm and a height of 180 mm to whose base 100 Nl/h of synthesis gas ($H_2$/CO in moles equal to 2) are fed.

The temperature, inside the reactor, at regime, is maintained at 250° C. and the pressure at 2 MPa.

After 10 hours of reaction, the stream of synthesis gas is stopped, the temperature is raised to 350° C. and 100 Nl/h of hydrogen are fed to activate the hydrocracking reaction which is completed after 5 hours.

Figure 2:
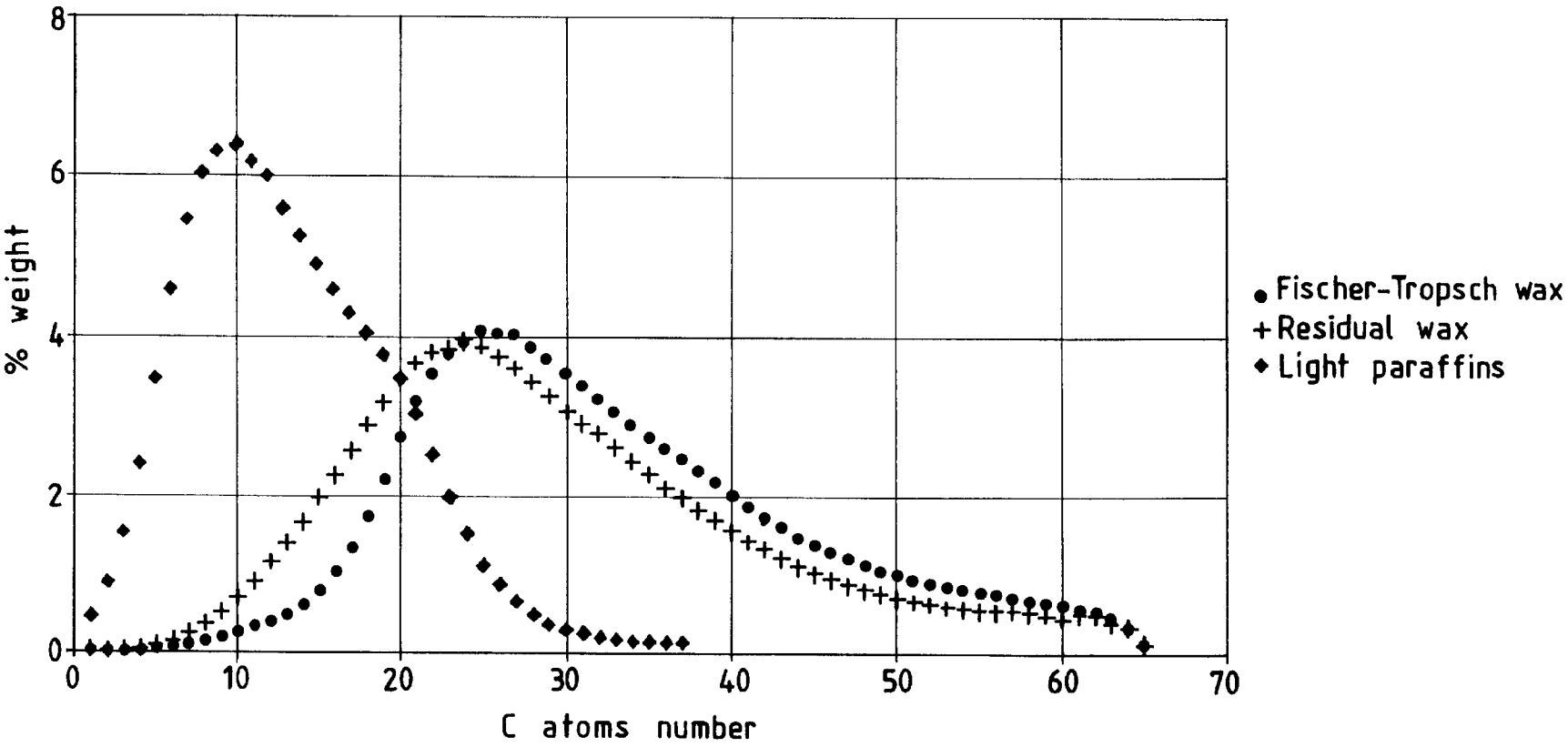
FIG. 2 shows the molecular weight distribution of fractions produced in the Fischer-Tropsch process of the present invention.

The diagram of FIG. 2 indicates the curves relating to the molecular weight distribution in the fractions produced.

The dotted curve represents the composition of the paraffinic wax which is obtained at the end of the Fischer-Tropsch reaction. The curve with the crosses refers to the composition of the liquid wax remaining after the hydrocracking. The curve with the squares represents the composition of the converted light paraffins after the hydrocracking.

EXAMPLE 2

The catalyst prepared in example 1 is used in a reactor/column for Fischer-Tropsch reactions (FT).

After activating the reaction, at regime, 100 l/h of a stream of synthesis gas with a molar ratio $H_2$/CO=2, are fed to the base of the reactor. The reaction is carried out at 225° C. and at a pressure of 3 MPa.

About 47 l/h of a stream in vapour phase with an average molecular weight of about 25, are discharged from the head of the reactor FT. About 0.44 l/h of wax at 30% by volume of solid (catalyst) are continuously removed from the head of the reactor and are fed to the head of a hydrocracking reactor operating at 400° C. and at the same pressure as the synthesis reactor. About 11 l/h of hydrogen are fed to the base of the hydrocracking reactor.

About 12 l/h of vapours are discharged from the head of the hydrocracking reactor whereas about 0.3 l/h of liquid waxes are recovered from the bottom, which are recycled, together with the catalyst, to the Fischer-Tropsch reactor.

The paraffinic vapours after condensation provide a liquid with a boiling point of 300° C.

What is claimed is:

1. A process for the production of hydrocarbons from synthesis gas which comprises:

a) feeding continuously to the bottom of a reactor for Fischer-Tropsch reactions, containing a catalyst comprising supported cobalt, a synthesis gas essentially consisting of hydrogen and carbon monoxide, in molar ratios $H_2$/CO ranging from 1 to 3;

b) continuously discharging from the reactor the Fischer-Tropsch reaction product essentially consisting of a hydrocarbon liquid phase containing the catalyst, in suspension;

c) feeding the Fischer-Tropsch reaction product, together with a hydrogen stream, to a hydrocracking reactor operating at a temperature ranging from 200 to 500° C.;

d) discharging a vapour phase essentially consisting of light hydrocarbons from the head of the hydrocracking reactor and from the bottom a suspension containing heavier products, which is recycled to the Fischer-Tropsch reactor;

e) cooling and condensing the vapour phase leaving the hydrocracking reactor, wherein the catalyst is catalytically active for both the Fischer-Tropsch reactions and hydrocracking reactions.

2. The process according to claim 1, wherein the reactor for Fischer-Tropsch type reactions is a vertical bubble reactor.

3. The process according to claim 1 or 2, wherein the Fischer-Tropsch reaction product in liquid phase essentially consists of paraffinic waxes which have a boiling point higher than 150° C.

4. The process according to claim 1, wherein the Fischer-Tropsch reaction is carried out at temperatures ranging from 150 to 400° C. and at a pressure ranging from 0.5 to 20 MPa.

5. The process according to claim 1, wherein the catalyst comprises 1 to 50% by weight cobalt supported on a solid consisting of at least one oxide of one or more element selected from Si, Ti, Al, Zn, and Mg.

6. The process according to claim 1, wherein the catalyst comprises from 0.05 to 5% by weight of ruthenium and from 0.05 to 5% by weight of at least a third element selected from those belonging to Group IIIB.

7. The process according to claim 1, wherein the catalyst comprises 0.05–5% by weight of tantalum.

8. The process according to claim 1, wherein the catalyst is a finely subdivided powder with an average particle diameter ranging from 10 to 700 micrometers.

9. The process according to claim 1, wherein the hydrocracking reactor operates at temperatures ranging from 200 to 500° C. and at pressures ranging from 0.5 to 20 MPa.

10. The process according to claim 1, wherein a vapour phase essentially consisting of $C_{5-}$–$C_{25+}$ paraffins is discharged from the hydrocracking reactor.

11. The process according to claim 1, wherein the catalyst comprises from 1 to 50% by weight cobalt, 0.05 to 5% by weight ruthenium, and from 0.05 to 5% by weight of at least a third element selected from Group IIIB, supported on a solid consisting of at least one oxide of one or more elements selected from Si, Ti, Al, Zn, and Mg.

12. The process according to claim 1, wherein the catalyst comprises from 1 to 50% by weight cobalt and 0.05 to 5% by weight tantalum supported on a solid consisting of at least one oxide of one or more elements selected from Si, Ti, Al, Zn, and Mg.

* * * * *